United States Patent [19]

Rohner

[11] Patent Number: 5,076,722

[45] Date of Patent: Dec. 31, 1991

[54] LOOSE LEAF BINDER

[75] Inventor: Benedikt Rohner, Zurich, Switzerland

[73] Assignee: Biella-Neher AG, Biel, Switzerland

[21] Appl. No.: 652,670

[22] Filed: Feb. 8, 1991

[30] Foreign Application Priority Data

Feb. 16, 1990 [CH] Switzerland ..... 501/90

[51] Int. Cl.[5] ..... B42F 13/20

[52] U.S. Cl. ..... 402/35; 402/34; 402/36; 402/80 R

[58] Field of Search ..... 402/26, 31, 34, 35, 402/36, 80 R

[56] References Cited

U.S. PATENT DOCUMENTS

| | | | |
|---|---|---|---|
| 2,004,570 | 6/1935 | Dawson . | |
| 2,789,561 | 4/1957 | Bonn et al. | 402/35 |
| 3,083,713 | 4/1963 | Meürer | 402/35 |
| 3,104,667 | 9/1963 | Mintz | 402/35 |
| 3,153,417 | 10/1964 | Newman . | |
| 4,349,289 | 9/1982 | Cardelini | 402/34 |

FOREIGN PATENT DOCUMENTS

| | | | |
|---|---|---|---|
| 1214197 | 4/1966 | Fed. Rep. of Germany . | |
| 1944530 | 4/1971 | Fed. Rep. of Germany . | |
| 3004830 | 8/1980 | Fed. Rep. of Germany | 402/38 |
| 2116481 | 9/1983 | United Kingdom . | |

*Primary Examiner*—Paul A. Bell

*Attorney, Agent, or Firm*—Oblon, Spivak, McClelland, Maier & Neustadt

[57] ABSTRACT

In a loose leaf binder the left (2a, 3a) and the right prong parts (2b, 3b) are each disposed on a common carrier plate (4). The carrier plates (4) are pivotably connected to a base plate (5) and can be depressed using a lever (8) against the force of coil springs (11) into a position in which they lie flat on the base plate. By pulling gently on the end of the catch (10) the binder is released and opens due to the force of the springs (11). Even in the opened state it is still possible to turn the sheets from one prong part to another without such turning being hindered by the lever.

9 Claims, 4 Drawing Sheets

LOOSE LEAF BINDER

Figure 1:
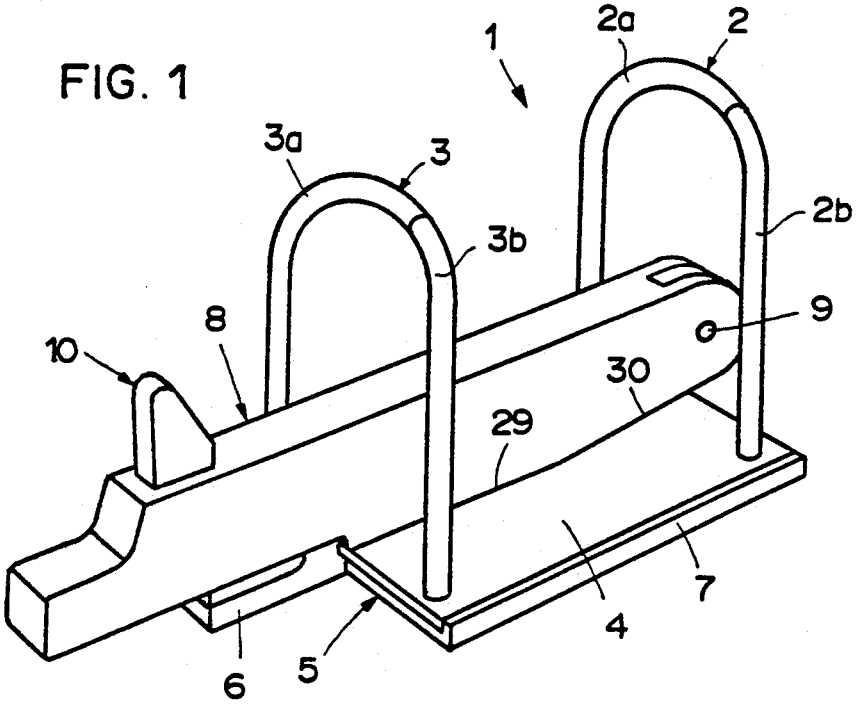

The invention relates to a loose leaf binder having at least two prongs 2,3, said prongs being divided in the upper region into a left *2a, 3a* and a right prong part *2b, 3b*, the prong parts of one or both sides being pivotable around a respective longitudinal axis to open the prongs.

Prior art binders for taking up perforated sheets of paper exist in a multiplicity of embodiments. Such binders have two or more prongs which are divided in the middle or outside the middle and affixed to a base element in such a way that they can be opened by pivoting one or both halves of the prongs to insert and remove sheets. To improve the handling of the mechanism when opening and shutting, those embodiments having an operating element have proved successful. Binders having an operating element in the form of a pivotably disposed lever are particularly widespread for use in large binders. The prongs on one side of the binder can be pivoted by means of the lever mechanism whilst the other prongs are fixed rigidly to the base plate. One disadvantage of this useful embodiment of a binder is that it is impossible to turn the sheets when the prongs are open since the lever which has been pivoted upwards blocks the way. However, there are also various prior art modifications and improvements to this kind of binder such as for example, those binders where the lever when open is fully pivotable, thus freeing the way for turning the sheets.

However, for the most part, the prior art solutions have disadvantages with respect to their handling and some are also complicated in their construction. A further disadvantage is that the outer structure of prior art binders with an opening element is often relatively uneven and does not meet modern requirements concerning the aesthetic appearance of the binder.

It is therefore an object of this invention to provide a loose leaf binder which allows sheets to be turned even when the prongs are open, which is simple to use and which has a clear outer form, consists of few individual parts and is inexpensive to manufacture. Furthermore, the binder should be a flat shape so that the greatest possible height is left free to stack sheets.

According to the invention, this object is solved by a loose leaf binder comprising:

a pair of carrier plates 4, the respective prong parts of one side being affixed to one of said carrier plates, a base plate 5, said carrier plates 4 being pivotably connected in the region of their respective outer edge with said base plate, a lever 8; 80, one end of said lever being pivotably connected to the centre of the rear portion of said base plate 5, said lever being intended to depress the portions of the carrier plates facing the middle of the base plate against the force of elastic means (11) downwards in the direction of said base plate, said base plate comprising at its front end means 10; 100 to block the movement of the lever.

Figure 2:
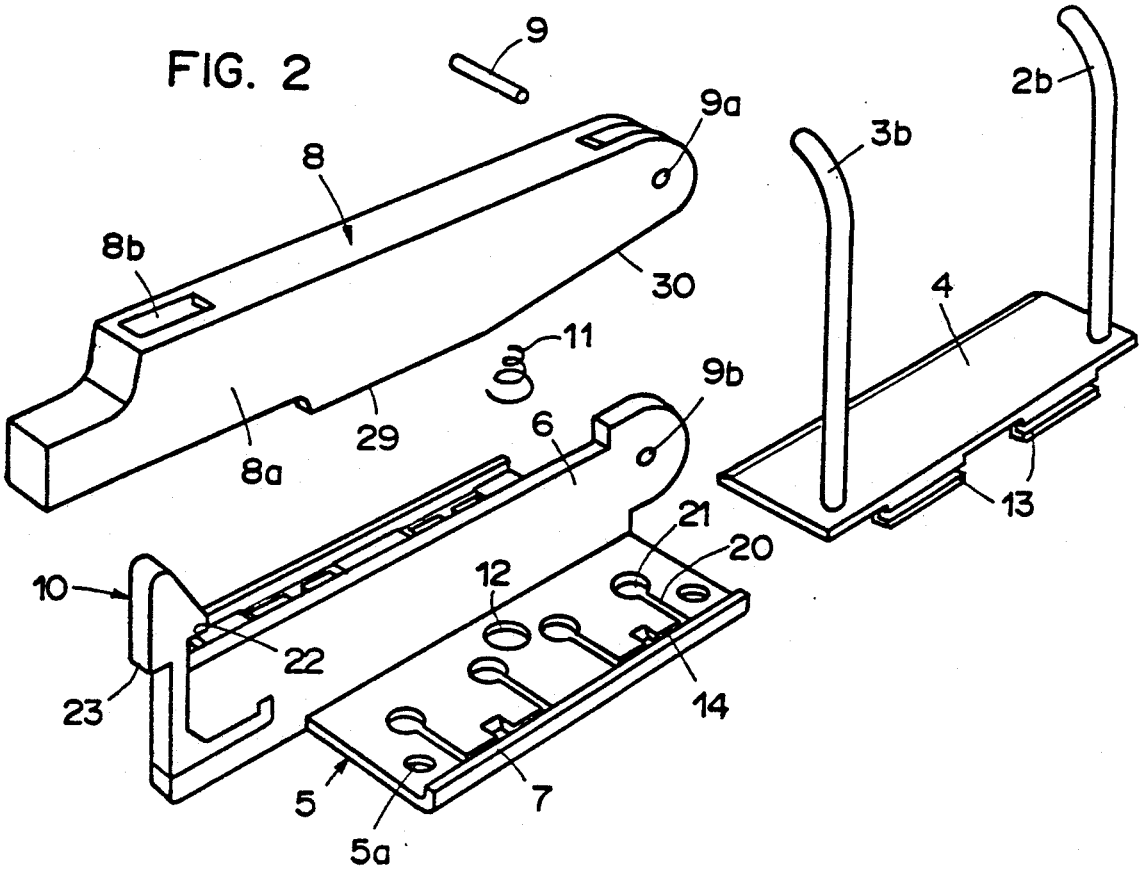
Figure 3:
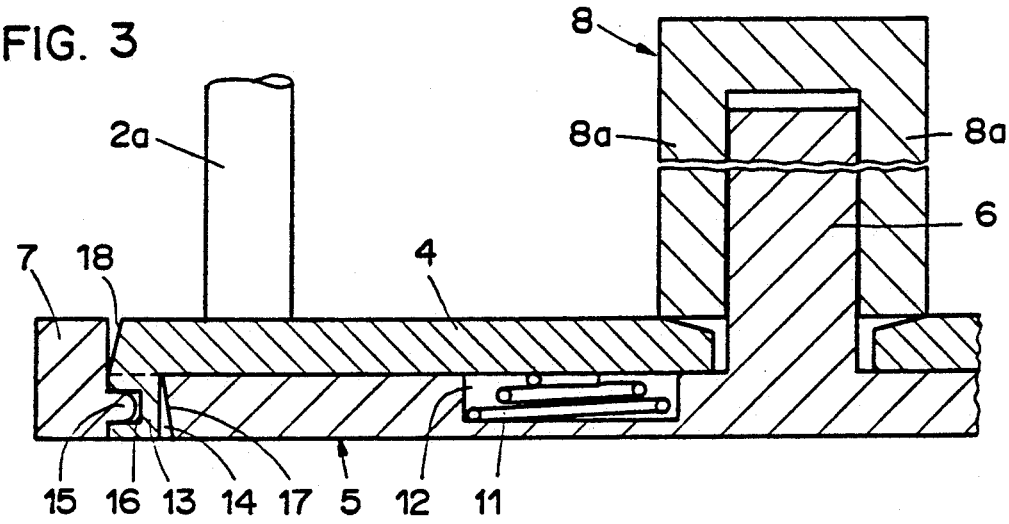
Figure 4:
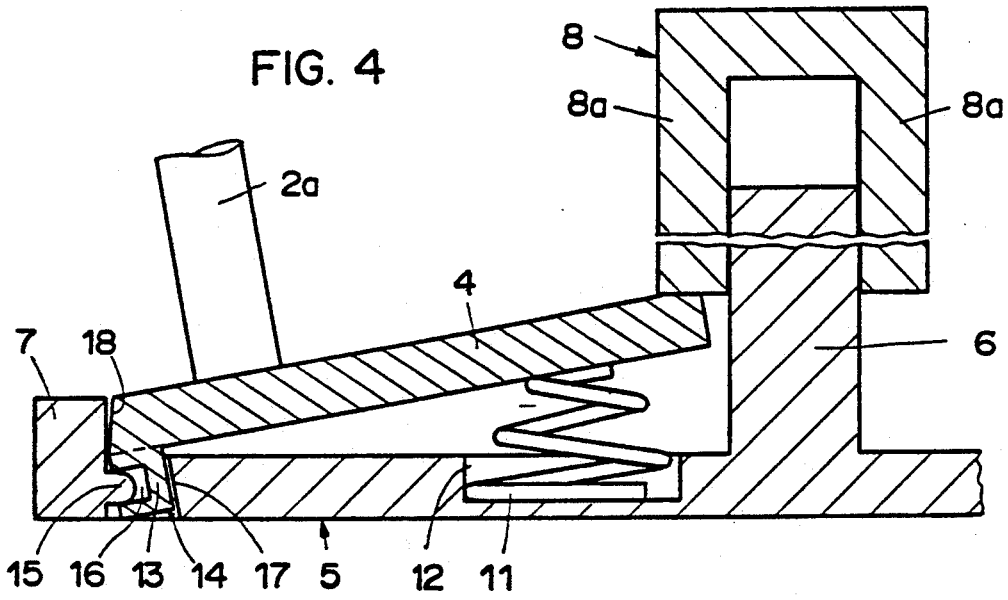
Figure 5:
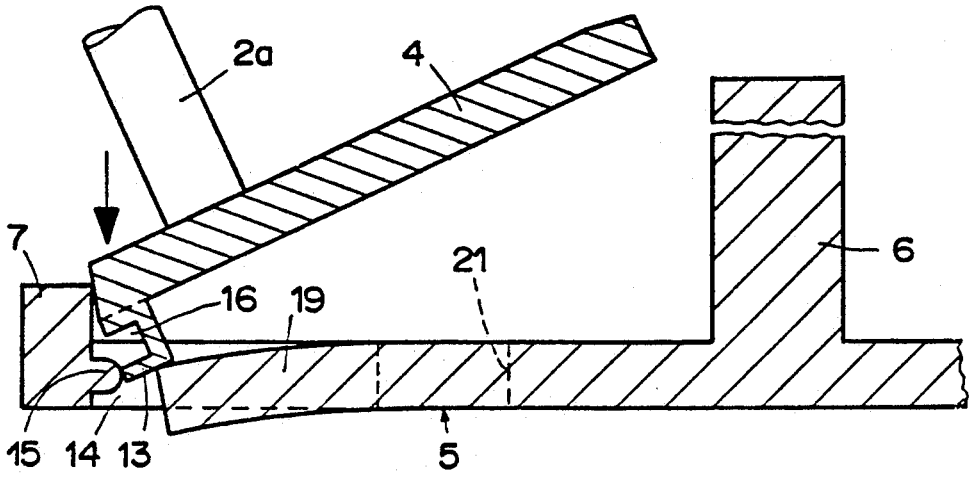
Figure 6:
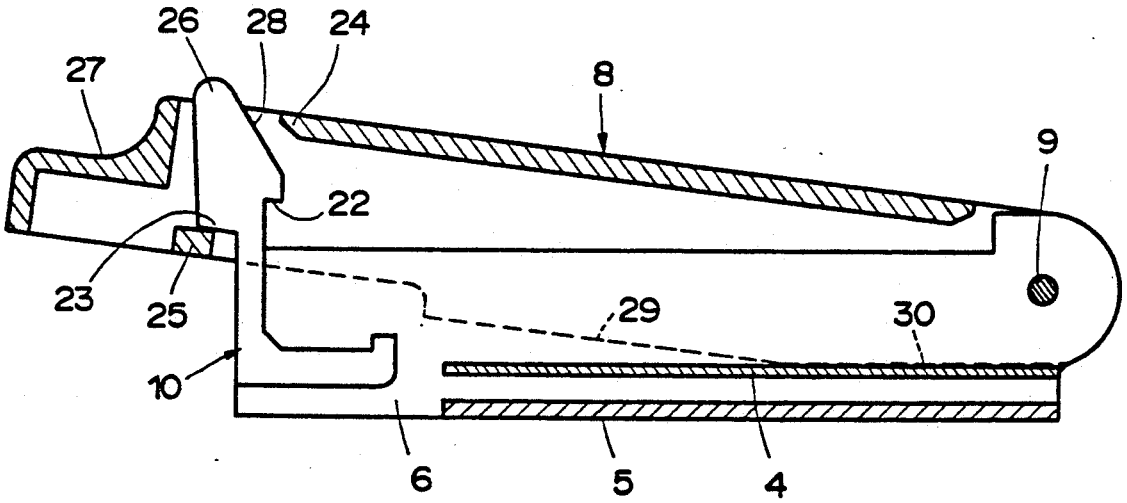
Figure 7:
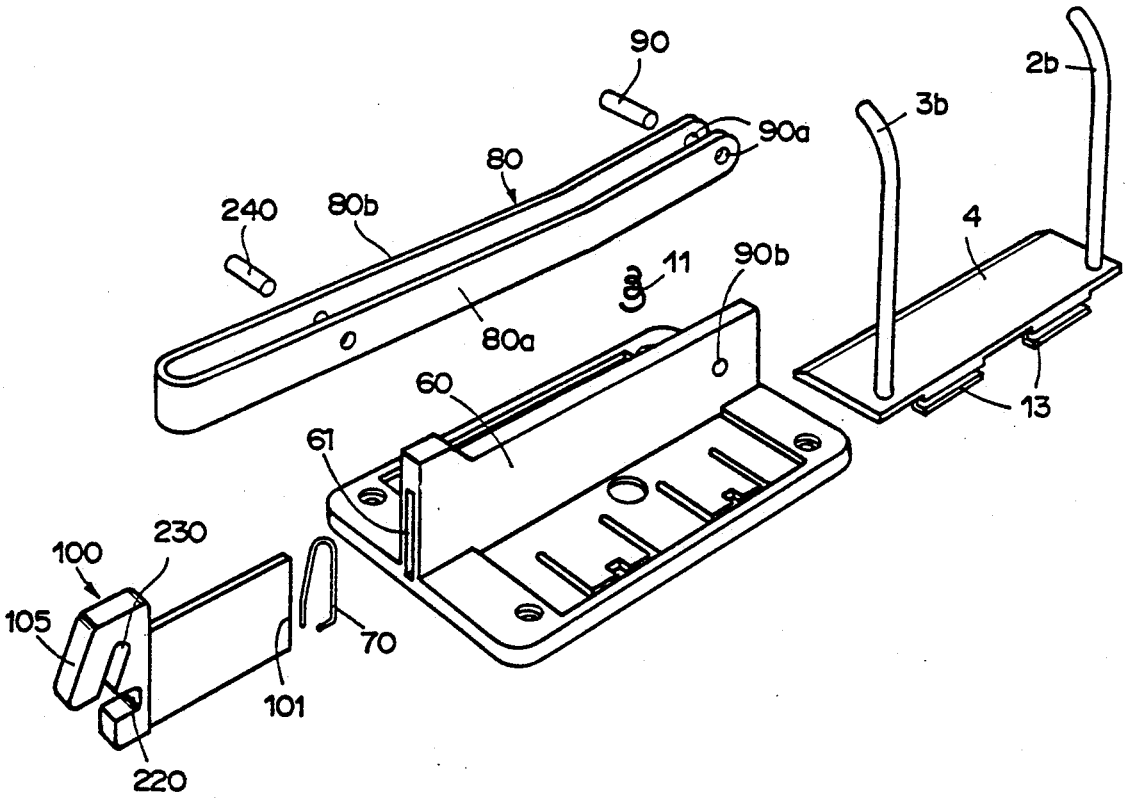

Preferred embodiments of the invention will now be described in more detail with reference to the accompanying drawings, in which:

FIG. 1 is a perspective view of the loose leaf binder according to the invention, FIG. 2 is a perspective exploded view of the binder according to the invention, FIG. 3 is a cross-section of the binder in the closed state, FIG. 4 is a cross-section of the binder in the open state, FIG. 5 is a cross-section through the binder during assembly of the carrier plate, FIG. 6 is a longitudinal section of the binder in the open state, FIG. 7 is a perspective exploded view of a second embodiment of the binder according to the invention.

The loose leaf binder 1 shown in perspective in FIG. 1 is provided with prongs 2, 3 to order perforated sheets. The prongs 2, 3 are each divided in their upper region into a left prong part *2a, 3a* and a right prong part *2b, 3b*. The division is located to the right of the middle of the prongs, so that the right prong parts *2b, 3b* have the shape of a post, the upper part of which being inclined slightly towards the middle of the mechanism. The prong parts of one side *2a, 3a* ; *2b, 3b* are each affixed to a common carrier plate 4. This fixation is preferably carried out in such a way that the foot of the prong parts is rivetted to the carrier plate, although other forms of connection are possible. The carrier plates 4 are pivotably connected with the binder's base plate in a way which shall be described later.

The base plate 5 is provided with a longitudinal flange 6 extending upwards from its centre. At the sides, longitudinally running rims 7 on both sides of the outer edge of the base plate 5 also extend upwards. The height of these rims 7 preferably corresponds to the thickness of the carrier plates 4, so that there is a smooth transition between both parts. The carrier plates 4 are preferably smooth and rectangular-shaped and cover the whole of the surface of the base plate in the region between the rims and the longitudinal flange, which aids the optical appearance of the binder. The binder is opened to insert and remove sheets by pivoting the respective carrier plates by the same amount in the region of their outer edge around an imaginary axis. For such operation there is an operating lever 8 which is pivotably connected with the longitudinal flange 6 by means of an axis 9. At the other end of the operating lever 8 there is a catch 10 to lock the binder.

As can be seen from FIG. 2, there is a coil spring 11 between the respective carrier plate 4 and the base plate 5, which presses against the carrier plate from below and thus moves the binder into the opened position. These springs are conically shaped and are fixed in position by indents 12 provided in the base plate 5. The conical shape of the coil springs 11 aids achievement of the desired flat shape of the whole binder. When the binder is closed, the carrier plates 4 lie essentially flat on the base plate 5, and the coil springs 11 are compressed to approximately their block length. In a conically shaped spring this length corresponds only to the diameter of its spring wire. The depth of the indents 12 is at least equivalent to that of the diameter of the wire of the spring. Furthermore, there are holes or indents *5a* in the base plate 5 in which projecting parts of the means for affixing the prong parts, for example screw or rivet heads, have space.

The operating lever 8 has the shape in cross-section of a U-profile open at the bottom. Thus the lever 8 acts like a cap over the longitudinal flange 6 and covers it over its entire length from the top downwards. The pivotable affixation of the operating lever 8 to the longitudinal flange 6 operates via the axis 9. This axis 9 projects through holes *9a* in the side walls *8a* of the lever and through a hole 9b in the longitudinal flange 6. The diameters of the holes and that of the axis are dimensioned such that it is possible on the one hand for the lever to move pivotably whilst on the other hand, it is not necessary to secure the pin axially to prevent it from falling out.

At the other end of the binder a catch 10 to lock the lever 8 is provided. The lower part of the catch 10 is connected with the longitudinal flange 6 and the upper part is movable by elastically deforming the catch. The catch projects through a gap 8b in the lever 8 so that it is essentially covered by the lever 8 and only its upper part is visible from the exterior. The locking means are designed such that there are two different fixed lever 8 positions. Consequently the lever, which at its other end is pivotably mounted, can assume two different angular positions.

The projections 13 extending from the carrier plate 4 in the region of its outer edge in the direction of the base plate serve the pivotable connection of the carrier plate 4 with the base plate 5. This latter is in turn provided with openings 14 which are dimensioned and located such that the projections 13 of the carrier plates 4 may be taken up by them. In conjunction with the rim 7 the position of the carrier plate is thereby fixed in the plane surface of the base plate. In order to fix the position of the carrier plate in a vertical direction to the base plate and in order to ensure the pivot movement, the openings 14, as can easily be seen in FIGS. 3 and 4, are each provided with a continous ridge 15 on the inner surface adjacent to the rim 7 of the base plate. The counterpart to the projections 13 of the carrier plate 4 is formed by the longitudinal slots 16 provided there on the side facing outwards, i.e. on the side adjacent to the ridge 15.

In the assembled state, the ridge 15 on the base plate engages with the longitudinal slot 16 of the carrier plate 4. The dimensions of the ridge 15 and the slot 16 are such that it is possible to pivot the carrier plate 4 with respect to the base plate within the angle limited by the locking means 10. The edge 17 of the base plate 5 adjacent to the projection 13 and the edge 18 of the carrier plate 4 adjacent to the rim 7 are inclined in order that there is space when the carrier plate is tilted. Furthermore, the inclined edges 17, 18, in conjunction with their respective opposite surface, limit the pivot movement of the carrier plate when the lever 8 is not yet assembled.

FIG. 5 shows the assembly of the carrier plate 4 on the base plate 5. In order to assemble it, the respective part 19 of the base plate 5 bordering on the openings 14 must be bent downwards, i.e. must be elastically deformed. In order to facilitate this, the parts 19 of the base plate are formed like a leaf spring. As can be seen from FIG. 2, there is a slit 20 for this purpose at the beginning and the end of each of the openings 14 provided in the base plate. These slits 20 run essentially perpendicular to the openings 14 towards the middle of the binder. The slits 20 end on the inside in a rounding out 21 in order to decrease the notch effect thereby avoiding tears or a breaking off due to bending of the part 19 formed like a leaf spring.

As shown in FIG. 5, the carrier plate 4 is assembled by engaging it with the base plate 5 such that the projections 13 press from above on the counterparts 19. The spring 11 is thereby housed in the indent 12 intended therefor. When the carrier plate is pressed down, the counterparts 19, which are formed like a leaf spring on account of the slit 20, bend downwards. Naturally, during assembly, the underside of the base plate 5 must rest free such that it is possible to bend the counterparts 19 downwards. When the projections 13 have pressed down far enough against the counterparts 19, the ridges 15 can each engage in the longitudinal slots 16, whereupon the projections 13 can slip completely into the openings 14 intended to receive them and the counterparts 19 can spring back. The inclination of the edges 17, 18 ensures a limitation of the angle of opening of the not yet fully assembled binder. This ensures that when the spring 11 is depressed, it is still possible to press the carrier plates 4 into the base plate 5 and that the spring is at least under some tension when the binder is in a partially assembled state. When the catch 10 has been engaged in the longitudinal flange 6, the lever 8 can be raised, the holes 9a and 9b can be aligned with each other and the axis 9 can be inserted.

The longitudinal section through the binder shown in FIG. 6 shows the function of the locking means. The locking means are comprised of a catch 10 having two projections 22, 23, disposed on the longitudinal flange 6, and of the two locking edges 24, 25 disposed on the lever 8. When the binder is closed by depressing the lever 8, the front projection 22 of the catch 10 engages with the locking edge 24 of the lever 8. To open the binder, the end 26 of the catch 10 is drawn backwards so that the locking edge 24 can pass the projection 22. Due to the pressure of the springs 11, the binder opens by pivoting the carrier plates 4 with the prong parts 2a, 3a ; 2b, 3b which are affixed thereto. The lever 8 is pivoted into a position until the back projection 23 of the catch 10 engages with the bottom locking edge 25 of the lever 8. The second locking stage is thereby achieved. This second locking stage cannot be loosened so that it is impossible for the lever 8 to pivot further beyond the position it would assume when the binder is open. In this way, the opening position of the binder is limited. The springs 11 are dimensioned such that they are still biassed even when the binder is open. Therefore, the second locking stage serves on the one hand to set a defined open position for the binder and to keep the way free at all times for sheets to be turned over, and on the other hand, to prevent the lever 8, which moves rapidly upwards due to the force of the spring, from knocking against the fingers of the person operating the binder.

To close the binder, the lever 8 is depressed by pressing on the step 27, whereupon the edge 24 presses against the inclination 28 adjoining the projection 22. When the lever 8 is depressed further, the end 26 of the catch 10 is deformed elastically rearwards until the projection 22 can pass over the locking edge 24. The catch 10 thereby springs back to its starting position and the edge 24 is engaged with the projection 22.

As can also be seen from FIG. 6, the lower side of the lever 8 has two different portions 29, 30, which are offset against each other by the amount of the angle of pivoting of the lever. Thus, in both the locking positions, the surface area of the lever 8, which is preferably made of plastic, lying against the carrier plates 4, is approximately the same each time, thus distributing the compressive force exerted by the spring 11 over as big an area as possible in both end areas.

FIG. 7 illustrates a second embodiment of the binder according to the invention. The pivotable lever 80 of the embodiment example illustrated in FIG. 7 is designed as a prong which which can be opened upwards. The suitably adapted shape of the longitudinal flange 60 can also be seen in FIG. 7. The operating lever 80 is pivotably affixed to the longitudinal flange 60 via the axis 90. This axis projects through holes 90*a* in the prong halves 80*a* of the pivotable lever 80 and through a hole 90*b* located at one end of the longitudinal flange 60. The diameter of the holes and the axes are dimensioned such that it is possible on the one hand for the lever to move pivotably whilst on the other hand, it is not absolutely necessary to secure the pin axially to prevent it from falling out.

At the other end of the longitudinal flange there is a catch 100 to lock the lever 80. FIG. 7 shows a second embodiment of this catch, although it should be noted that the binder according to the invention can also be provided with other embodiments of a catch. Thus it is possible to equip the first embodiment of the binder according to the invention illustrated in the above figures with a lever of the type shown in FIG. 7. It is also possible to equip the second embodiment of the binder according to the invention shown in FIG. 7 with a catch of the type created with reference to the first embodiment of the binder illustrated in the above figures.

The front part 101 of the catch 100 illustrated in FIG. 7 rests in a recess in the longitudinal flange 60. Between the frontal area of the front part 101 of the catch 100 and the rear surface of the recess 61 in the longitudinal flange 60 there is a space housing a pressure spring 70. The catch 100 is configured such that the two locking edges 220, 230 are disposed at different heights and can interact with a locking pin 240 located between the two prong halves of the lever 80. When the binder is closed, the locking pin 240 engages with the lower locking edge 220 of the catch 100. To open the mechanism, the catch is pressed into the recess 61 of the longitudinal flange 60 by finger pressure on its end surface 105 against the pressure of the spring 70. The locking pin 240 is thereby disengaged from the locking edge 220 and the lever 80 pivots upwards due to the pressure springs disposed between the carrier plate and base plate. The locking pin 240 thereby passes through the slit connecting the two locking edges 220 and 230 and finally comes to engage with the upper locking edge 230, and further pivoting of the lever 80 upwards is blocked. This catch defines the opening angle of the binder.

The binder described is characterized by simplicity of operation with respect to opening and shutting and by the fact that it enables sheets to be turned freely, even when open. The binder is furthermore characterized by a flat shape which frees a large height for stacking sheets.

I claim:

1. A loose leaf binder having at least two prongs 2, 3, said prongs being divided in the upper region into a left 2*a*, 3*a* and a right prong part 2*b*, 3*b* the prong parts of one or both sides being pivotable around a respective longitudinal axis to open the prongs, said binder comprising:

a pair of carrier plates 4, the respective prong parts of one side being affixed to one of said carrier plates, a base plate 5, said carrier plates 4 being pivotably connected in the region of their respective outer edge with said base plate, a lever 8; 80, one end of said lever being pivotably connected to the centre of the rear portion of said base plate 5, said lever being intended to depress the portion of the carrier plates facing the middle of the base plate against the force of elastic means (11) downwards in the direction of said base plate, said base plate comprising at its front end means 10; 100 to block the movement of the lever.

2. A binder according to claim 1, wherein each of the carrier plates (4) is provided in the region of their outer edge with at least one projection (13) running in the direction of the base plate, said projection (13) being provided on the outwardly facing side with a longitudinal slot (16), wherein the base plate (5) is provided on both sides on each outer edge with a rim (7), wherein the base plate has openings (14) in the region adjacent to this rim to take up the said projections (13) of the carrier plates (4), wherein each of the inner surfaces of the openings (14) adjacent to the rim (7) of the base plate (5) is provided with a retaining ridge (15) which engages with the longitudinal slot (16) on the projection (13) of the carrier plate (4).

3. A binder according to claim 2, wherein the base plate (5) is provided with slits (20) running essentially perpendicular to the openings to give a leaf spring-like configuration to each region (19) bordering on the openings.

4. A binder according to claim 1, wherein the locking means (10) have a first locking stage (22, 24) to block the movement of the lever (8) when the binder is closed and a second locking stage (23, 25) to lock the movement of the lever (8) when the binder is open, and wherein the first locking stage can be released to open the binder by moving the spring-back end (26) of the lever.

5. A binder according to claim 1, wherein the locking means (100) have a first locking stage (220, 240) to block the movement of the lever (80) when the binder is closed, and a second locking stage (230, 240) to block the lever (80) when the binder is open and wherein the first locking stage can be released to open the binder by depressing the catch (100).

6. A binder according to one of claim 1, wherein there is a longitudinal flange (6) in the centre of the base plate (5), to one of the ends of which the lever (8) is affixed and wherein the lever (8) has essentially the cross-sectional shape of a U-profile which is open towards the bottom and covers the longitudinal flange from the top downwards.

7. A binder according to claim 1, wherein the lower edge of the lever has two regions (29, 30) which are set off against each other by the opening angle of the lever.

8. A binder mechanism according to claim 1, wherein the elastic means (11) are conical coil springs disposed between the base plate (5) and the carrier plate (4).

9. A loose leaf binder having at least two prongs 2, 3, said prongs being divided in the upper region into a left 2*a*, 3*a* and a right prong part 2*b*, 3*b* the prong parts of one or both sides being pivotable around a respective longitudinal axis to open the prongs, said binder comprising:

a pair of carrier plates 4, the respective prong parts of one side being affixed to one of said carrier plates, a base plate 5, said carrier plates 4 being pivotably connected in the region of their respective outer edge with said base plate, a lever 8; 80, one end of said lever being pivotably connected to the centre of the rear portion of said base plate 5, said lever being intended to depress the portion of the carrier plates facing the middle of the base plate against the force of elastic means (11) downwards in the direction of said base plate, said base plate comprising at its front end means 10; 100 to block the movement of the lever and wherein each of the carrier plates (4) is provided in the region of their outer edge with at least one projection (13) running in the direction of the base plate, said projection (13) being provided on the outwardly facing side with a longitudinal slot (16), wherein the base plate (5) is provided on both sides on each outer edge with a rim (7), wherein the base plate has openings (14) in the region adjacent to this rim to take up the said projections (13) of the carrier plates (4), wherein each of the inner surfaces of the openings (14) adjacent to the rim (7) of the base plate (5) is provided with a retaining ridge (15) which engages with the longitudinal slot (16) on the projection (13) of the carrier plate (4) and wherein the base plate (5) is provided with slits (20) running essentially perpendicular to the openings to give a leaf spring-like configuration to each region (19) bordering on the openings.

* * * * *